US007575309B2

(12) United States Patent
Childs et al.

(10) Patent No.: US 7,575,309 B2
(45) Date of Patent: Aug. 18, 2009

(54) FLUID SUPPLY SYSTEM

(75) Inventors: Ashley E. Childs, Corvallis, OR (US); Robert S. Wickwire, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 541 days.

(21) Appl. No.: 11/064,811

(22) Filed: Feb. 24, 2005

(65) Prior Publication Data

US 2006/0187279 A1 Aug. 24, 2006

(51) Int. Cl.
*B41J 2/175* (2006.01)

(52) U.S. Cl. ..... 347/86; 347/85

(58) Field of Classification Search ..... 347/86, 347/85

See application file for complete search history.

(56) References Cited

U.S. PATENT DOCUMENTS

| | | | | |
|---|---|---|---|---|
| 4,591,870 | A | 5/1986 | Braun et al. | |
| 4,703,330 | A | 10/1987 | Culpepper | |
| 5,455,615 | A | 10/1995 | Burr et al. | |
| 5,537,136 | A | 7/1996 | Brandon et al. | |
| 5,677,718 | A | 10/1997 | Crawford et al. | |
| 5,781,212 | A | 7/1998 | Burr et al. | |
| 6,176,573 | B1 | 1/2001 | Barth et al. | |
| 6,652,080 | B2 | 11/2003 | Childs et al. | |
| 6,682,186 | B2 | 1/2004 | Smith et al. | |
| 6,739,706 | B2 | 5/2004 | Barinaga et al. | |
| 6,752,493 | B2 | 6/2004 | Dowell et al. | |
| 6,817,705 | B1 | 11/2004 | Crockett et al. | |
| 2002/0027583 | A1 | 3/2002 | Hirotake | |
| 2002/0101478 | A1 | 8/2002 | Roy et al. | |
| 2003/0048337 | A1 | 3/2003 | Jones et al. | |
| 2003/0128257 | A1 * | 7/2003 | Qingguo et al. | 347/85 |
| 2004/0218026 | A1 | 11/2004 | Matsushita et al. | |
| 2004/0233261 | A1 * | 11/2004 | Clark et al. | 347/93 |
| 2006/0164473 | A1 | 7/2006 | Davis et al. | |

FOREIGN PATENT DOCUMENTS

| | | |
|---|---|---|
| EP | 0 683 050 A2 | 11/1995 |
| EP | 0867290 | 9/1998 |
| EP | 0875385 | 11/1998 |
| EP | 0887189 | 12/1998 |
| EP | 0 965 452 A1 | 12/1999 |
| WO | WO 00/21755 | 4/2000 |

OTHER PUBLICATIONS

International Search Report for Application No. PCT/US2006/006121. Report Issued Aug. 3, 2006.

* cited by examiner

*Primary Examiner*—Manish S Shah
*Assistant Examiner*—Laura E Martin

(57) ABSTRACT

A fluid supply system for a printing device is disclosed. The fluid supply system includes an ink reservoir adapting member operatively disposed within an ink cartridge. The adapting member has an open end and an end opposed to the open end. The open end is adapted to have a filter disposed thereon. The opposed end is substantially angularly offset from the open end in a manner sufficient to substantially promote fluid and air migration toward a fluid conduit. A depth between the open end and the opposed end substantially varies along a length between two opposed sides of the adapting member. A predetermined area of the opposed end defines the fluid conduit, and the predetermined area is located at a region where the depth is substantially greatest. Further, the conduit is adapted to release fluid and air from the adapting member.

9 Claims, 7 Drawing Sheets

FLUID SUPPLY SYSTEM

BACKGROUND

The present disclosure relates generally to fluid supply systems, and more particularly to fluid supply systems for printing devices.

Many current printing systems incorporate ink channels and in-line filters. In some systems, the in-line filters have areas that substantially match the cross-sectional area of the ink channels. The substantially matched areas may result in a high pressure drop, which, in some instances, limits high ink flux performance of the system. Relatively tall chambers underneath the filters are often used for ink flow. However, these chambers generally do not entrain air bubbles in a purging ink flow, thus allowing bubbles to accumulate over time, potentially blocking flow of ink to the printhead, resulting in a pen failure. Other ink channels may include ribs defined in the center to assist in purging or to structurally support the filter. However, in some instances, the ribs substantially reduce the usable area of the filter, thus potentially impacting the high ink flux performance of the system.

Further, such systems often include printhead carriers whose inner geometry has a substantially high steady state pressure drop and a substantially slow transient response during burst printing. In some instances, the inner geometry results in undesirable eddy regions and areas of dead flow during purging. Further, the relatively slow transient response may also cause low and inconsistent drop weight at high frequency printing.

Consequently, there is a need for new fluid supply systems.

BRIEF DESCRIPTION OF THE DRAWINGS

Objects, features and advantages will become apparent by reference to the following detailed description and drawings, in which like reference numerals correspond to similar, though not necessarily identical components. For the sake of brevity, reference numerals having a previously described function may not necessarily be described in connection with subsequent drawings in which they appear.

DETAILED DESCRIPTION

Embodiment(s) of the present disclosure provide a fluid supply system and a printhead carrier that are suitable for use in a fluid cartridge in a printing device. Without being bound to any theory, it is believed that the geometry of the fluid supply system and/or the printhead carrier substantially enhances effective air or other gas management within the fluid cartridge. Further, the fluid supply system may include an angularly offset end and rounded sides that may substantially eliminate dead flow regions and assist in air and fluid flow toward a fluid conduit. The printhead carrier geometry also may substantially decrease dead flow regions, substantially increase transient response, and/or create an area for air storage (e.g. temporary air storage).

Figure 1:
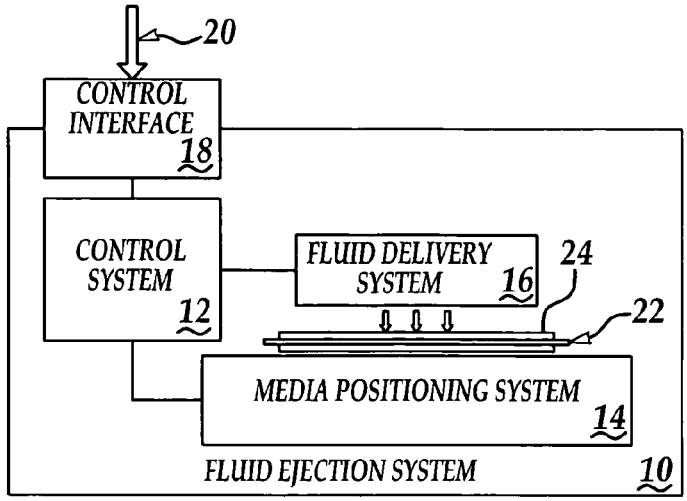
FIG. 1 is a schematic diagram of an embodiment of a fluid ejection system.

Referring now to FIG. 1, an embodiment of a fluid ejection system 10 is schematically shown. While it is to be understood that fluid ejection systems may be configured to eject a variety of different fluids onto a corresponding variety of different media, the embodiment(s) disclosed herein focus on a printing system used to eject, or print, ink onto ink media. It is to be understood, however, that other printing systems, as well as fluid ejection systems designed for nonprinting applications, are also intended to be within the scope of this disclosure.

Fluid ejection system 10 includes a control system 12, a media positioning system 14, a fluid delivery system 16, and a control interface 18. Control system 12 may include components, such as a printed circuit board, processor, memory, application specific integrated circuit, etc., which cause fluid ejection corresponding to a received fluid ejection signal 20. Fluid ejection signals 20 may be received via a wired or wireless control interface 18, or other suitable mechanism. The fluid ejection signals 20 may include instructions to perform a desired fluid ejection process. Upon receiving such a fluid ejection signal 20, the control system 12 may cause media positioning system 14 and fluid delivery system 16 to cooperate to eject fluid onto media 22. As a non-limiting example, a fluid ejection signal 20 may include a print job defining a particular image to be printed. The control system 12 may interpret the print job and cause fluid, such as ink, to be ejected onto media, such as paper, in a pattern replicating the image defined by the print job.

Media positioning system 14 may control the relative positioning of the fluid ejection system 10 and media 22 onto which the fluid ejection system 10 ejects fluid. For example, media positioning system 14 may include a paper feed that advances paper through a printing zone 24 of the fluid ejection system 10. The media positioning system 14 may additionally or alternatively include a mechanism for laterally positioning a printhead (shown as 76 in FIG. 2), or other suitable device, for ejecting fluid to different areas of the desired media in the printing zone 24. The relative position of the media 22 and the fluid ejection system 10 may be controlled, so that fluid may be ejected onto a desired portion of the media 22. In some embodiments, media positioning system 14 may be selectively configurable to accommodate two or more different types and/or sizes of media.

Figure 2:
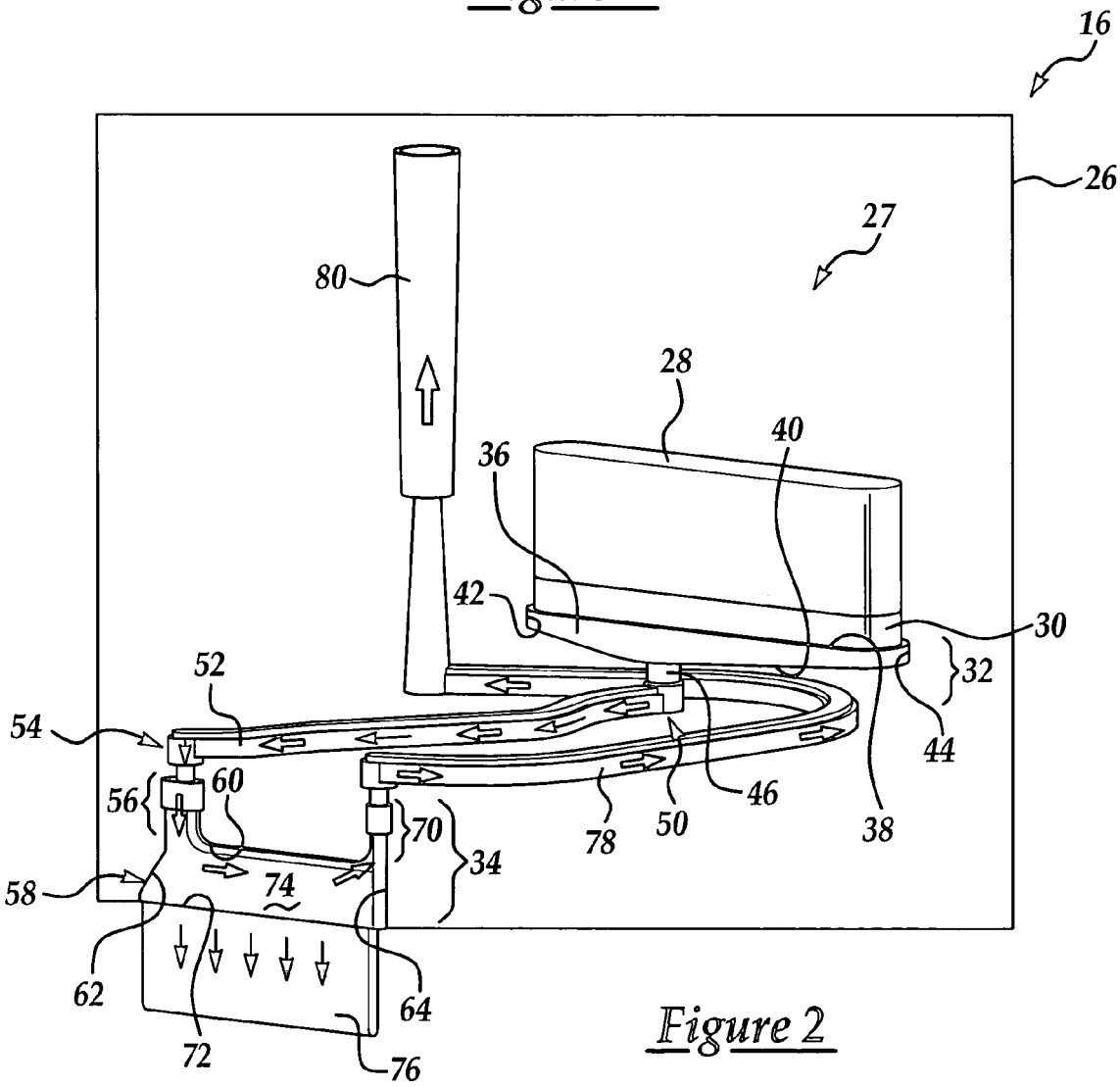
FIG. 2 is a semi-schematic perspective view of an embodiment of a fluid routing system within a cartridge.

FIG. 2 depicts an embodiment of the fluid delivery system 16. In this embodiment, the fluid delivery system 16 includes a cartridge 26 and a printhead 76. The cartridge 26 generally includes a fluid routing system 27 having a cartridge fluid reservoir 28, a filter 30, a fluid supply system 32, a printhead carrier 34, and manifolds 52, 78.

It is to be understood that cartridge 26 may be made of any suitable material; and in an embodiment, the cartridge 26 is made of a variety of plastics, non-limitative examples of which include polypropylenes, polypropylenes alloyed with polystyrenes, polyphenylene oxide, and mixtures thereof.

A fluid reservoir 28 is positioned such that it is in fluid communication with the filter 30, which is disposed on the fluid supply system 32. The fluid reservoir 28 generally contains a supply of ink used in a printing system.

Figure 3:
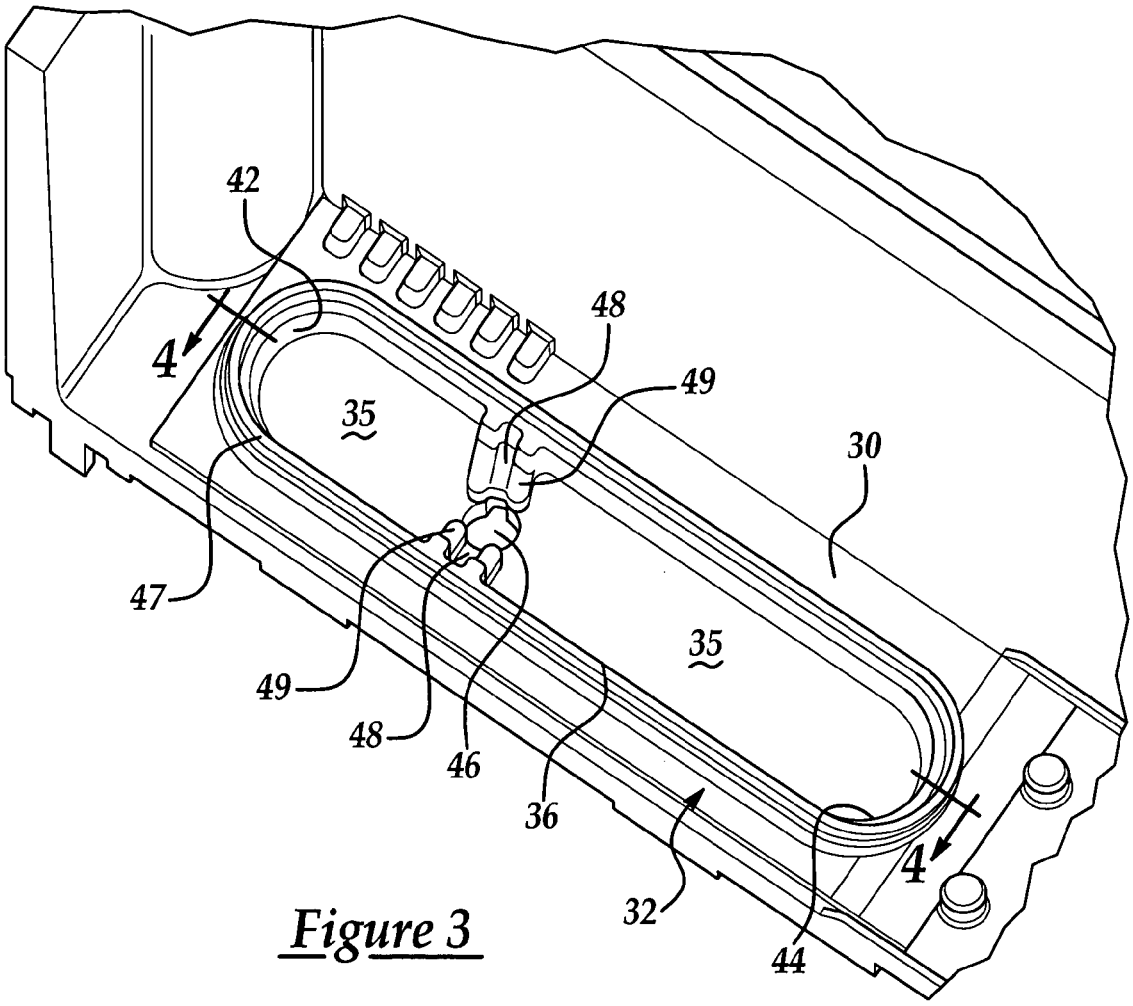
FIG. 3 is a top perspective view of an embodiment of a fluid supply system, with a transparent filter thereon.
Figure 4:
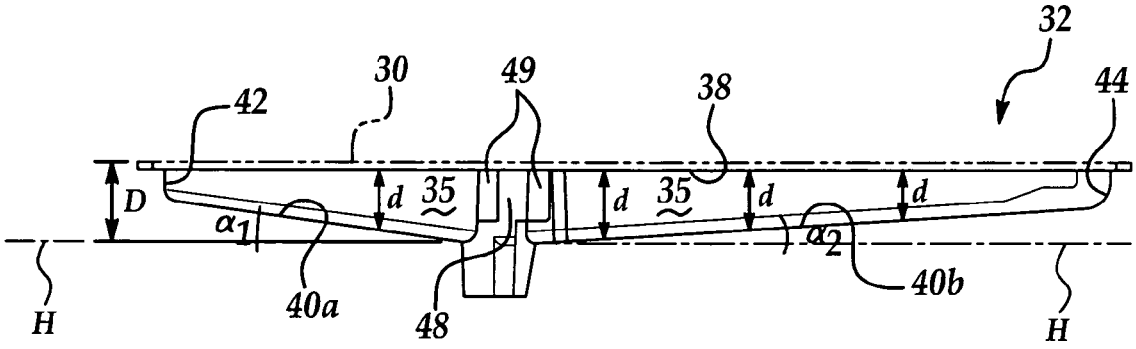
FIG. 4 is a cross-sectional view taken on line 4-4 of FIG. 3, but showing a filter thereon.
Figure 5:
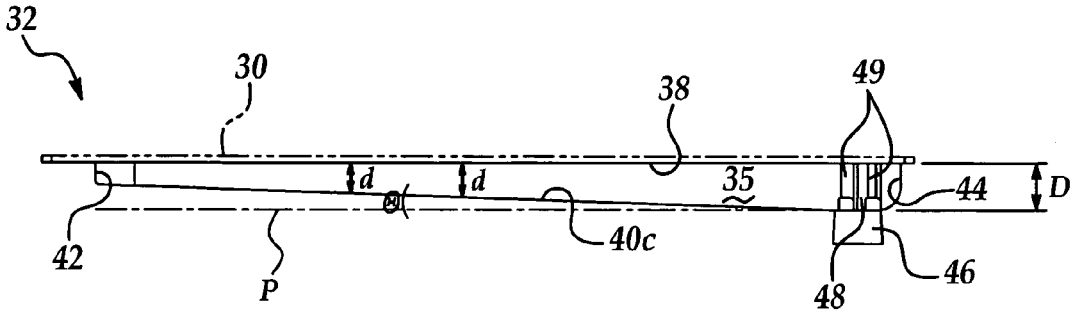
FIG. 5 is a schematic side view of another embodiment of a fluid supply system.

The fluid supply system 32 (a top perspective view of which is shown in FIG. 3 and cross-sectional and side views of which are shown in FIGS. 4 and 5, respectively) includes an ink reservoir adapting member 36 having an open end 38 and an opposed end 40 that is opposed to the open end 38. As depicted in FIG. 2, the open end 38 is adapted to have the filter 30 disposed thereon. FIG. 3 depicts the open end 38 having a filter or heat stake perimeter 47 upon which the filter 30 may be secured, for example, via a heat seal. It is to be understood that the region 35 defined by the adapting member 36 receives fluid that has passed through the filter 30 (which is transparently shown in FIG. 3 over the fluid supply system 32) from the fluid reservoir 28.

The adapting member 36 may also include two substantially rounded, opposed fluid-contacting sides 42, 44 defined between the open end 38 and the opposed end 40. Without being bound to any theory, it is believed that the rounded, opposed fluid-contacting sides 42, 44 advantageously substantially reduce dead flow areas in the adapting member 36. The rounded ends 42, 44 substantially eliminate corners that are generally capable of trapping air. In an embodiment, the rounded edges eliminate (as compared to a conventional, rectangular adapting member) about 1 $mm^2$ from each corner, and about 4 $mm^2$ from the adapting member 36. In an embodiment, the region 35 defined by the adapting member 36 has an area of about 91 $mm^2$, which would have been about 95 $mm^2$ in the conventional, rectangular adapting member.

The opposed end 40 is substantially angularly offset from the open end 38. As such, a depth (examples of which are shown at reference letter d in FIGS. 4 and 5) between the open end 38 and the opposed end 40 substantially varies along at least a portion of the length between the two opposed sides 42, 44. In an embodiment, the greatest depth (shown at reference letter D in FIGS. 4 and 5) is less than about 2 millimeters. In an alternate embodiment, the varying depth d ranges between about 0.7 mm and about 1.7 mm.

A predetermined area of the opposed end 40 defines a fluid conduit 46. It is to be understood that the predetermined area may be located at or adjacent a region where the depth d of the adapting member 36 is substantially greatest (e.g., depth D). The fluid conduit 46 releases fluid and air from the adapting member 36. Without being bound to any theory, it is believed that the angularly offset opposed end 40 substantially promotes fluid and air migration toward the fluid conduit 46. The angled opposed end 40 forces fluid to fill the ends 42, 44 of the adapting member 36 by driving air bubbles toward the area with the substantially greatest depth D, or where the fluid conduit 46 is located. Further, the air bubbles have a tendency to remain spherical, thereby forcing themselves to the deepest area of the adapting member 36. For example, it is believed that the surface tension forces of bubbles large enough to touch both the filter 30 and the opposed end 40 assist in moving air toward the fluid conduit 46.

It is to be understood that the opposed end 40 may be angularly offset at any desired angle that is sufficient to substantially promote fluid and air migration toward the fluid conduit 46. In an embodiment, the angles may be limited, at least in part, by materials and processes used in forming the geometry in the adapting member 36 in order to ensure that the desired substantially greatest depth D is achieved. In a non-limitative example, the angle may be limited, at least in part, by the plastic injection molded parts used to form the adapting member 36.

FIGS. 4 and 5 depict alternate embodiments of the opposed end 40. Referring now to FIG. 4, the opposed end 40 includes two sections 40*a*, 40*b* that converge at an area where the fluid conduit 46 is defined. It is to be understood that the two sections 40*a*, 40*b* are angularly offset from each other. In a non-limitative example, from the horizontal plane H, section 40*a* has an angle $\alpha_1$ of about 8° and section 40*b* has an angle $\alpha_2$ of about 3.7°.

Referring now to FIG. 5, the opposed end 40 is one section that has the fluid conduit 46 defined in an area adjacent one of the opposed sides 42, 44, here the opposed side 44. In a non-limitative example, from the horizontal plane P, the opposed end 40*c* has an angle θ of about 2°.

Embodiment(s) of the fluid supply system 32 may also include capillary grooves 48 and capillary ribs 49 defined in the adapting member 36 (shown in FIG. 3) adjacent the fluid conduit 46 to enable fluid (e.g. ink) to flow past a bubble during periods of low fluid flux, such as, for example, during printing. During periods of high fluid flux, such as purging, the bubbles are removed by the purging fluid flow.

Referring back to FIG. 2, the filter 30 may be a standpipe filter that has an area that is substantially equal to or larger than an area of adapting member 36 defined by a substantially greatest length and a substantially greatest width of the adapting member 36 upon which the filter 30 is disposed. It is to be understood that the filter area may advantageously assist in ensuring high ink flux performance (low pressure drop). In an embodiment, the filter 30 has an aspect ratio (length:width) ranging from about 5:1 (a non-limitative example of which is about 22.3 mm long by about 4.25 mm wide) to about 7.5:1.

The fluid conduit 46 of the fluid supply system 32 is fluidly coupled to one end region 50 of an inlet manifold 52. The other end region 54 of the inlet manifold 52 is fluidly coupled to an inlet 56 of the printhead carrier 34. As such, fluid and air released from the fluid supply system 32 enters the inlet manifold 52 and is delivered to the inlet 56 of the printhead carrier 34.

Referring now to FIGS. 2, 6, 7 and 8 together, embodiment(s) of the printhead carrier 34 includes a housing 58 having a substantially horizontal inner wall 60 and two opposed sides 62, 64. The housing 58 further includes a region 72 opposed to the inner wall 60, with a plenum 74 defined therebetween.

Figure 6:
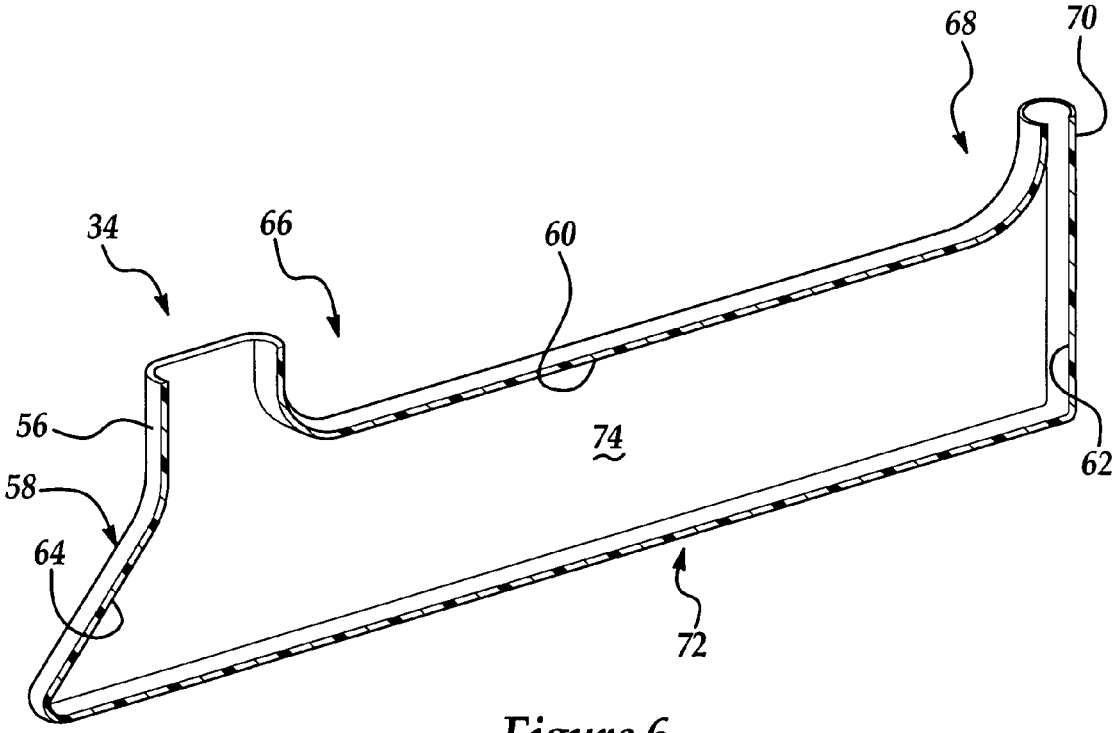
FIG. 6 is an isometric cross sectional view of an embodiment of a region inside a printhead carrier.
Figure 7:
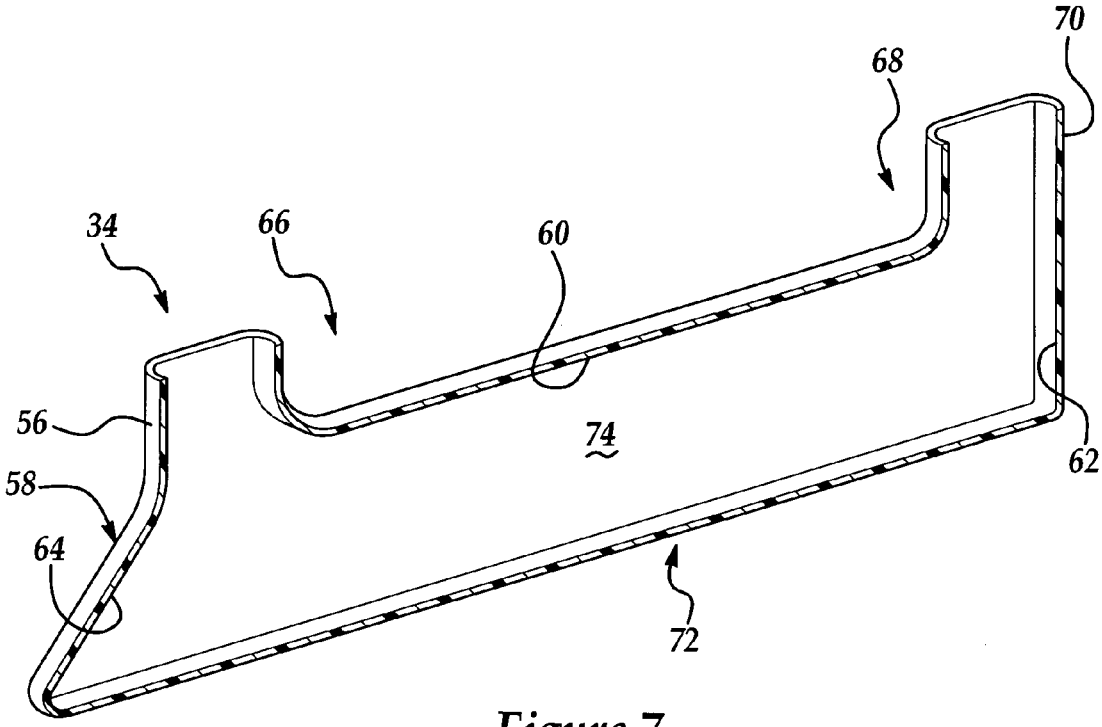
FIG. 7 is an isometric cross sectional view of an alternate embodiment of a region inside a printhead carrier.
Figure 8:
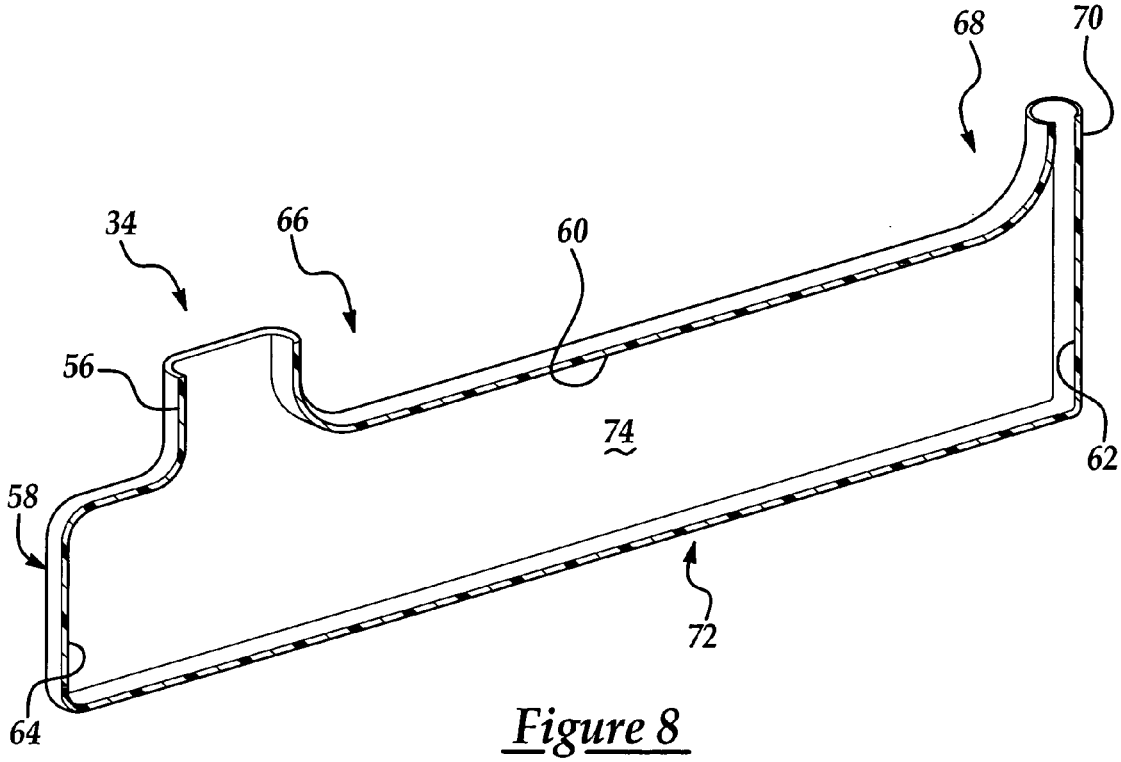
FIG. 8 is an isometric cross sectional view of a further alternate embodiment of a region inside a printhead carrier.

As depicted in FIGS. 6, 7 and 8, the opposed sides 62, 64 may be configured to have similar geometries (see, for example, FIGS. 6 and 7 which depict one opposed side 62 substantially vertical and the other opposed side 64 angularly offset as compared to the substantially vertical opposed side 62) or may be configured to have substantially similar geometries (see, for example, FIG. 8 which depicts one opposed side 62 substantially vertical and the other opposed side 62 having a portion that is substantially vertical and a portion leading to the inlet 56 that is substantially horizontal).

It is to be understood that the housing 58 of the printhead carrier 34 may be made of any suitable material that is capable of sustaining its shape and structural integrity in the presence of the fluid and in the environment of the fluid ejection system 10. Examples of such materials include, but are not limited to ceramics (e.g. alumina), stainless steel, glass, plastics, and mixtures thereof.

The inlet 56 is defined in the wall 60 at an end 66 substantially adjacent the opposed side 64. In an embodiment, the inlet 56 has a substantially oblong cross-section. Without being bound to any theory, it is believed that the oblong cross-section of inlet 56 provides a substantially lower overall pressure drop and a substantially faster response in transient flow, thus reducing drop weight loss during high frequency printing.

The region 72 of the housing 58 may be coupled to an ink slot (not shown) operatively disposed in a printhead or die 76. The printhead 76 is configured to dispense fluid from the plenum 74 to desired media.

In certain exemplary embodiments, the plenum 74 defined between the region 72 and the inner wall 60 may have a volume ranging from about 30 $mm^3$ to about 103 $mm^3$. In a non-limitative example, the volume is about 39.3 $mm^3$. The substantially horizontal geometry of the inner wall 60 advantageously increases space in plenum 74, thus allowing the plenum 74 to temporarily warehouse air passed from the inlet manifold 52 (and the fluid supply system 32) and/or generated from the printhead 76 between purge cycles. In an embodiment, the volume available in the plenum 74 for warehousing air ranges from about 21 $mm^3$ to about 72 $mm^3$. In the non-limitative example where the plenum volume is 39.3 $mm^3$, the temporary warehouse volume is about 27.5 $mm^3$, which is about 70% of the total plenum volume. Current plenum geometries typically have a volume of about 27.3 $mm^3$ and may warehouse about 19.6 $mm^3$ of air. Embodiment (s) of the plenum 74 are about 40% larger than the traditional geometries, thus the volume for warehoused air is advantageously increased.

Figure 9:
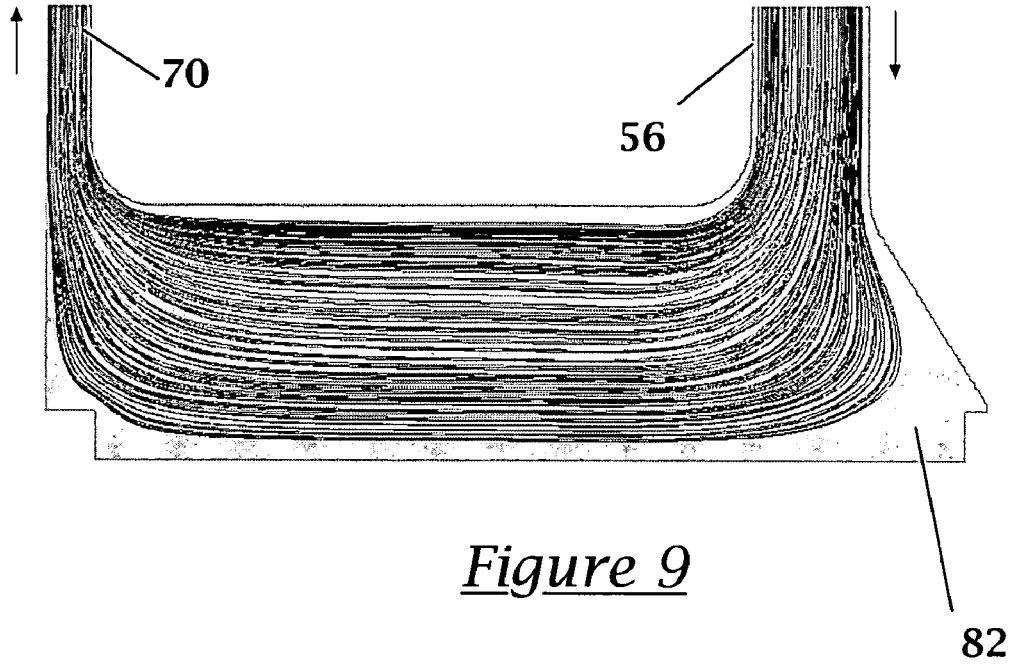
FIG. 9 is a graph depicting the flow field in an embodiment of a printhead carrier.
Figure 10:
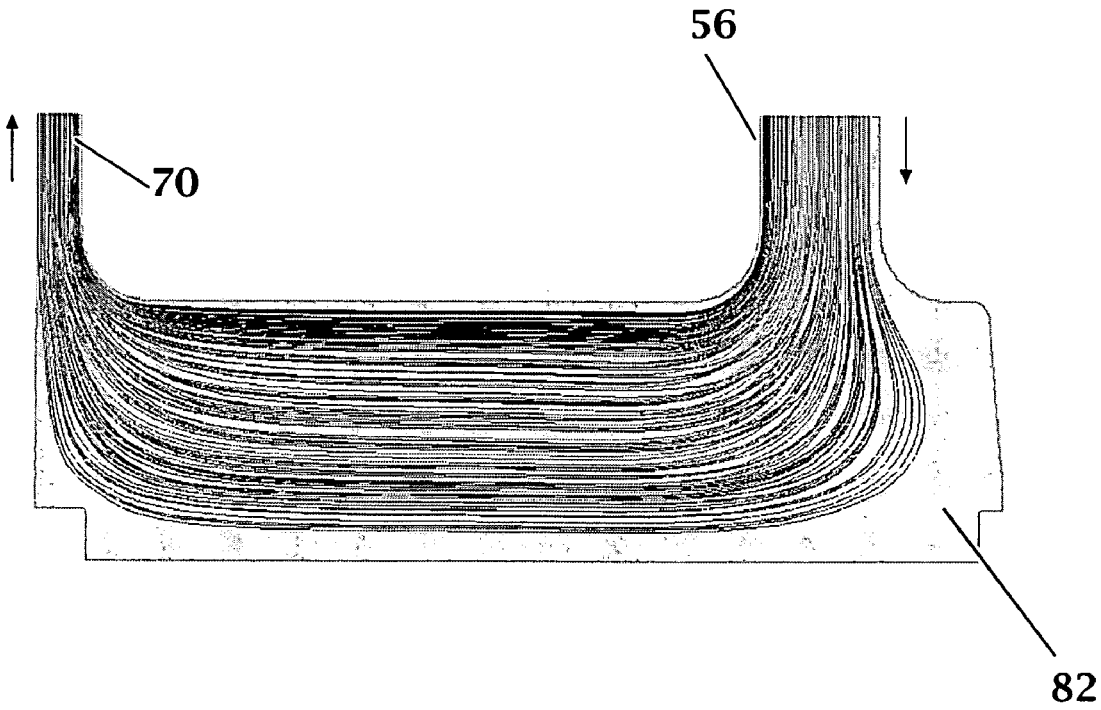
FIG. 10 is a graph depicting the flow field in an alternate embodiment of a printhead carrier.
Figure 11:
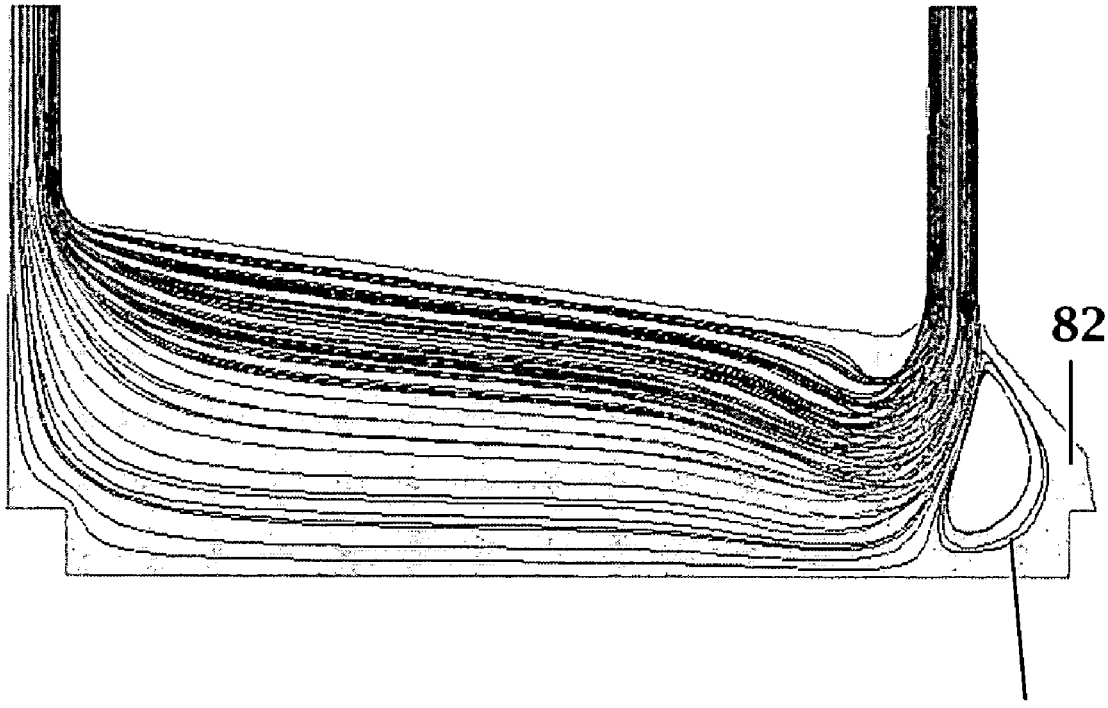
FIG. 11 is a graph depicting the flow field in a typical printhead carrier.

The plenum 74 also enables the supply of ink (fluid) to all nozzles of the printhead 76 with minimum dynamic loss and fastest flow rate development (i.e. transient response), despite the presence of the warehoused air. Current plenum geometries (a non-limitative example of which is shown in FIG. 11) generally have a pressure drop of about 1.1 inches of water during purging flow at 6 cc/min, while the plenum geometry described herein (non-limitative examples of which are shown in FIGS. 9 and 10) has a pressure drop of about 0.7 inches of water during purging flow at 6 cc/min. In addition to this lower steady state pressure drop during sustained printing or purging flow, the transient response is also improved, thereby advantageously enabling the fluid ejection system 10 to fire drops of substantially consistent mass at higher frequencies than previous designs. It is to be understood that the mean drop weight variation, for example at 24 kHz, changes from about 0.6 ng below target (typical geometry) to about 0.3 ng above target (plenum 74 geometry), where zero drop weight variation is the target. Further, the standard deviation of the drop weight variation generally drops from 0.7 ng (typical geometry) to about 0.3 ng (plenum 74 geometry).

Referring more specifically to FIGS. 9 through 11, the flow fields of two embodiments of the printhead carrier 34 (FIGS. 9 and 10) and the flow field of a traditional printhead carrier (FIG. 11) are depicted. As illustrated, the geometries of the housing 58 of the embodiment(s) disclosed herein enable substantially uniform fluid flow/fluid flow lines during the purge cycle through the plenum 74, such that dead zones 82, eddy regions 84, or stagnant areas are substantially eliminated, and warehoused air is substantially efficiently removed through an outlet 70.

The outlet 70 is defined in the wall 60 at a second end 68 substantially adjacent the opposed side 62 of the housing 58. The outlet 70 may have a substantially circular cross-section (see FIG. 6) or may have a substantially oblong cross-section (see FIG. 7) that may be similar to the oblong inlet 56. The outlet 70 may be fluidly coupled to an outlet manifold 78. The outlet 70 is adapted to have purge air from the adapting member 36, the inlet manifold 52, and the plenum 74 flow therethrough. It is to be understood that the substantially vertical portion 80 of the outlet manifold 78 may be connected to a valve system and a pumping system, both of which are used in purging cycles.

In FIG. 2, the solid arrows represent the flow of ink (or fluid) from the reservoir 28 to the printhead 76, and the hollow arrows represent the flow of air from the fluid supply system 32, through the inlet manifold 52 and the plenum 74, and out the outlet 70 and the outlet manifold 78.

Figure 12:
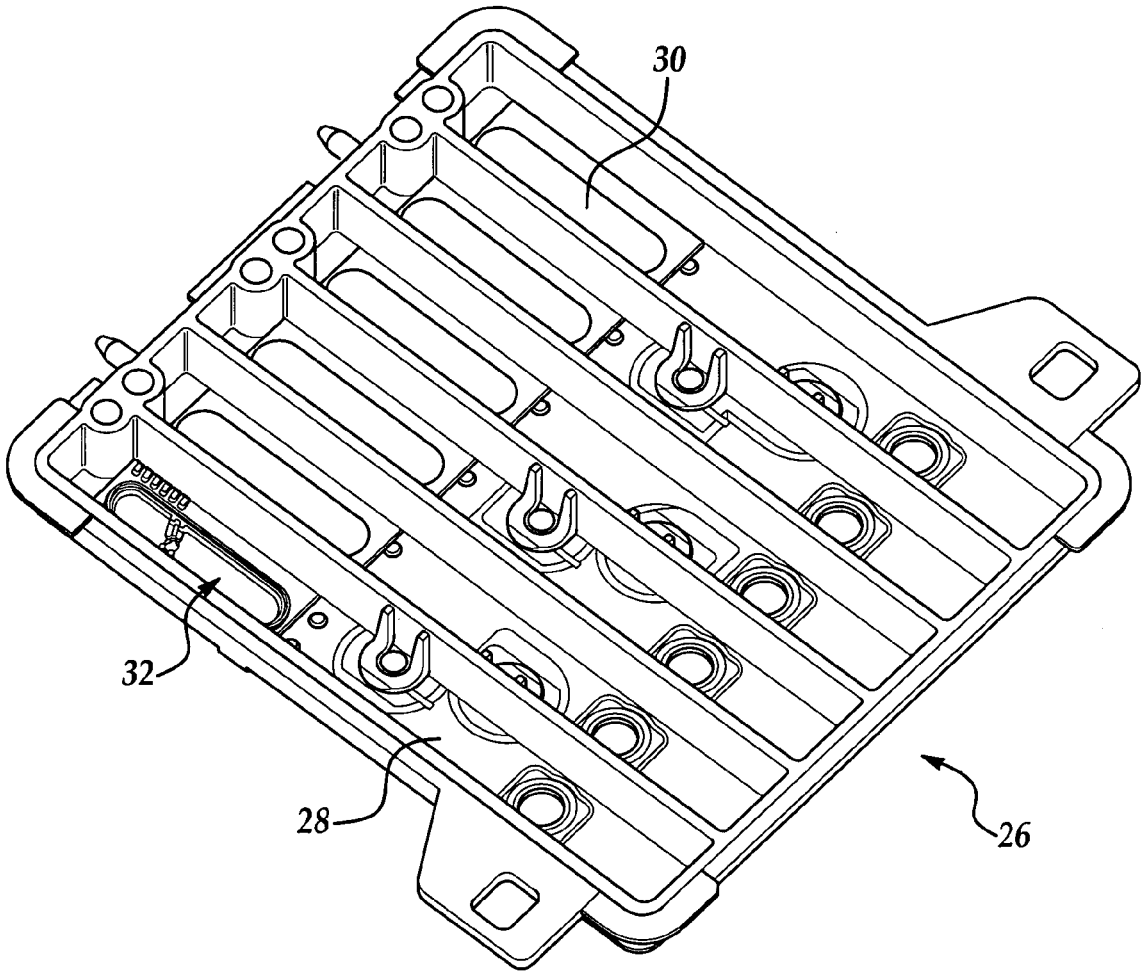
FIG. 12 is a top perspective view of an embodiment of an ink cartridge having a plurality of ink reservoirs and fluid supply systems.

Referring now to FIG. 12, a portion of an embodiment of an ink cartridge 26 is depicted. The ink cartridge includes a plurality of ink reservoirs 28. It is to be understood that each ink reservoir 28 may house substantially different colored inks. As depicted, each of the ink reservoirs 28 is in fluid communication with a filter 30 that is sealed to an embodiment of the fluid supply system 32. As such, the ink cartridge 26 may include a plurality of fluid supply systems 32, each of which is fluidly connected to a respective inlet manifold 52 that may be fluidly coupled to a printhead carrier 34 as described herein.

A general description of air accumulation and purging is as follows. Air bubbles accumulate in the printhead carrier plenum 74 during printing and idle times. This is due, at least in part, to air diffusion and dissolved gas in the ink coming out of solution during printing. This accumulated air is removed from the inlet manifold 52, the printhead carrier plenum 74, and the region 35 defined by the adapting member 36 under the filter 30 by initiating a purge sequence. The purge flow is driven by a pump (not shown) in the printer 10. A valve (not shown) is opened to allow connection of the pump's flow to the outlet manifold 78, and ink flow through the inlet manifold 52 and printhead carrier 34 out the outlet manifold 78, thus moving air with it. The valve is then switched to a position that allows connection to the fluid reservoir 28, and the pump reverses direction to pump the fluid and air into the fluid reservoir 28, where there is larger air accumulation capacity. The air is later removed during another process.

Embodiment(s) of the fluid supply system 32 and the printhead carrier 34 have many advantages, including, but not limited to the following. Both the system 32 and carrier 34 are suitable for use in a fluid (e.g. ink) cartridge. Without being bound to any theory, it is believed that the geometry of the fluid supply system 32 and/or the printhead carrier 34 substantially advantageously enhances effective purging of air from the fluid cartridge 16. Further, the fluid supply system 32 includes an angularly offset opposed end 40 and/or rounded sides 42,44 that may substantially eliminate dead flow regions and assist in air and fluid to flow toward the fluid conduit 46. The printhead carrier 34 geometry also substantially decreases dead flow regions during purging, thereby improving the effectiveness of removing air; substantially increases transient response; and creates an area for temporary air storage, thereby advantageously increasing the time between purges.

While several embodiments have been described in detail, it will be apparent to those skilled in the art that the disclosed embodiments may be modified. Therefore, the foregoing description is to be considered exemplary rather than limiting.

What is claimed is:

1. A fluid supply system for a printing device, the fluid supply system comprising:

an ink reservoir adapting member operatively disposed within an ink cartridge, the adapting member having an open end and an end opposed to the open end, the open end adapted to have a filter disposed thereon, the opposed end substantially angularly offset from the open end in a manner sufficient to substantially promote fluid and air migration toward a fluid conduit, the ink reservoir adapting member having two substantially rounded, opposed, fluid-contacting sides defined between the open end and the opposed end, wherein a depth between the open end and the opposed end substantially varies along at least a portion of a length between two opposed sides of the adapting member; and a predetermined area of the opposed end defining the fluid conduit, the predetermined area located at a region where the depth is substantially greatest, the conduit adapted to release fluid and air from the ink reservoir adapting member.

2. The fluid supply system as defined in claim 1 wherein the substantially greatest depth is less than about 2 millimeters.

3. The fluid supply system as defined in claim 1 wherein the opposed end comprises two sections which converge at an area, the two sections being angularly offset from each other, and wherein the fluid conduit is defined substantially adjacent the area at which the two sections converge.

4. The fluid supply system as defined in claim 1 wherein the fluid conduit is defined in an area of the opposed end substantially adjacent one of the opposed sides.

5. The fluid supply system as defined in claim 1 wherein the filter has an aspect ratio ranging from about 5:1 to about 7.5:1.

6. The fluid supply system as defined in claim 1 wherein the open end has a filter disposed thereon and wherein the filter is in fluid communication with a fluid reservoir.

7. The fluid supply system as defined in claim 6 wherein the filter has an area that is substantially equal to or greater than an area of the adapting member defined by a substantially greatest length of the adapting member and a substantially greatest width of the adapting member.

8. The fluid supply system as defined in claim 6 wherein the filter is a standpipe filter.

9. An ink supply system for a printing device, the ink supply system comprising:

an ink reservoir adapting member operatively disposed within an ink cartridge, the adapting member having an open end and an end opposed to the open end, the open end having a filter disposed thereon, the opposed end substantially angularly offset from the open end in a manner sufficient to substantially promote fluid and air migration toward a fluid conduit, the ink reservoir adapting member having two substantially rounded, opposed, fluid-contacting sides defined between the open end and the opposed end, wherein a depth between the open end and the opposed end substantially varies along a length between the two opposed sides, and wherein the filter is in fluid communication with a fluid reservoir; and a predetermined area of the opposed end defining a fluid conduit, the predetermined area located at a region where the depth is substantially greatest, the conduit adapted to release fluid and air from the ink reservoir adapting member;

wherein the filter has an area that is substantially equal to or greater than an area of the ink reservoir adapting member defined by a substantially greatest length of the adapting member and a substantially greatest width of the adapting member.

* * * * *